US008270661B2

(12) United States Patent
Sørensen et al.

(10) Patent No.: US 8,270,661 B2
(45) Date of Patent: Sep. 18, 2012

(54) HIGH EFFICIENT MINIATURE ELECTRO-ACOUSTIC TRANSDUCER WITH REDUCED DIMENSIONS

(75) Inventors: Kurt Sørensen, Horsens (DK); Andreas Sørensen, århus C (DK); Morten Kjeldsen Åndersen, Odder (DK)

(73) Assignee: Gettop Europe R&D APS, Herlev (DK)

( * ) Notice: Subject to any disclaimer, the term of this patent is extended or adjusted under 35 U.S.C. 154(b) by 1057 days.

(21) Appl. No.: 12/142,518

(22) Filed: Jun. 19, 2008

(65) Prior Publication Data

US 2008/0317276 A1 Dec. 25, 2008

Related U.S. Application Data

(60) Provisional application No. 60/945,231, filed on Jun. 20, 2007.

(51) Int. Cl.
*H04R 21/02* (2006.01)

(52) U.S. Cl. ..... 381/421; 381/401

(58) Field of Classification Search ..... 381/421, 381/401, 407, 412, 420
See application file for complete search history.

(56) References Cited

U.S. PATENT DOCUMENTS

| | | | | |
|---|---|---|---|---|
| 5,461,677 | A * | 10/1995 | Raj et al. | 381/422 |
| 6,744,895 | B2 * | 6/2004 | Miyamoto et al. | 381/182 |
| 2002/0168074 | A1 | 11/2002 | Miyamoto et al. | |
| 2006/0188126 | A1 | 8/2006 | Andersen et al. | |

FOREIGN PATENT DOCUMENTS

| | | | |
|---|---|---|---|
| CN | 1384653 | A | 12/2002 |
| JP | 01106700 | | 4/1989 |
| WO | WO 03/063545 | A1 | 7/2003 |

OTHER PUBLICATIONS

European Search Report for European Patent Application No. 08158672.9, dated Nov. 25, 2008.
English Translation of Office Action from Chinese Application No. 200810178576.1, Dated Apr. 19, 2012.

* cited by examiner

*Primary Examiner* — Charles Garber
*Assistant Examiner* — Reema Patel
(74) *Attorney, Agent, or Firm* — Nixon Peabody LLP

(57) ABSTRACT

The present invention relates to a miniature electro-acoustic transducer including a magnetic circuit, a diaphragm and a voice coil operatively connected to the diaphragm. The magnetic circuit includes first and second air gap portions adapted to receive first and second voice coil segments, respectively. The magnetic flux acting on the first voice coil segment is provided by inner magnetic means and first outer magnetic means in combination and the magnetic flux acting on the second voice coil segment is essentially provided by the inner magnetic means only.

21 Claims, 5 Drawing Sheets

HIGH EFFICIENT MINIATURE ELECTRO-ACOUSTIC TRANSDUCER WITH REDUCED DIMENSIONS

CROSS-REFERENCE TO RELATED APPLICATION

This application claims the benefit of priority to U.S. Provisional Application 60/945,231, filed on Jun. 20, 2007, entitled "High Efficient Miniature Electro-Acoustic Transducer with Reduced Dimensions," which is hereby incorporated by reference in its entirety.

FIELD OF THE INVENTION

The present invention relates to a miniature electro-acoustic transducer with reduced dimensions. In particular, the present invention relates to a miniature electro-acoustic transducer comprising an asymmetric magnetic circuit where only two opposing air gaps are arranged between flux generating magnets, such as permanent magnets.

BACKGROUND OF THE INVENTION

Future mobile phones are expected to be more compact and nevertheless able to produce higher sound pressure levels than mobile phones of today. Therefore, loudspeaker designs for mobile phones are pushed in the direction of smaller sizes, more power handling and higher maximum sound pressure capability etc. in order to match the above-mentioned requirements. Also, miniature transducers for handheld devices are under a constant pressure from market demands towards more extreme form factors. Therefore, issues like thermal and acoustical ventilation in miniature loudspeakers or speakers become more and more critical.

The smallest achievable width of prior art miniature transducers is primarily given by the dimensions of an outer magnet and a diaphragm suspension. Thus, if the width of the miniature transducer is to be reduced, the dimensions of the outer magnet and the diaphragm suspension need to be reduced. Another solution could be to omit the outer magnet. However, without the outer magnet the motor of the transducer becomes significantly weaker in strength. In addition, the dimensions of the voice coil also become significantly smaller with thermal problems as a result.

It is an object of the present invention to provide a miniature transducer with reduced dimensions while maintaining the acoustical performance.

It is an advantage of the miniature transducer according to the present invention that it provides, at the same time, a very small width of the transducer, a strong motor and a moving coil with an increased circumference giving optimal thermal conditions.

SUMMARY OF THE INVENTION

The above-mentioned object is complied with by providing, in a first aspect, a miniature electro-acoustic transducer comprising a magnetic circuit, a diaphragm and a voice coil operatively connected to the diaphragm, wherein the magnetic circuit comprises first and second air gap portions adapted to receive first and second voice coil segments, respectively, wherein magnetic flux acting on the first voice coil segment is provided by inner magnetic means and first outer magnetic means in combination, and wherein magnetic flux acting on the second voice coil segment is essentially provided by said inner magnetic means only.

As used herein, "acting on" is intended to mean that the magnetic flux provided by inner magnetic means and first outer magnetic means spatially overlaps with the respective voice coil segments. Also, as used herein, "operatively connected" is intended to mean that the voice coil may be attached directly to the diaphragm, or attached to the diaphragm via another element which is directly attached to the diaphragm.

Thus, it is a characteristic feature of the miniature transducer according to the first aspect of the present invention that the magnetic circuit is asymmetric in that the magnetic fluxes in the first and second air gaps are generated in very different ways. According to the first aspect of the present invention, the magnetic flux in the first air gap may be generated by two magnetic means, such as two permanent magnets, in combination. These two magnets may be a common inner magnet in combination with a first outer magnet. Contrary to this, the magnetic flux in the second air gap may be primarily generated by a single magnet only, said single magnet preferable being the common inner magnet. In this way, an outer magnet along the second air gap can be omitted whereby the width of the miniature transducer may be reduced in a direction perpendicular to the orientation of the second air gap. Despite the asymmetric nature of the magnetic circuit, the flux densities in the first and second air gaps are preferably essentially equal in strength.

As used herein, the terms "inner" and "outer" refer to the positioning of the magnetic means relative to a given air gap. Thus, an inner magnetic means is positioning in the direction towards the center of the miniature transducer, i.e. on a center-side of a given air gap. Optionally an inner magnetic means may coincide with a center point of the miniature transducer. Contrary to this, an outer magnetic means is positioned on the opposite side of a given air gap. The definitions of the terms "inner" and "outer" also apply for the following aspects (second to sixth) of the present invention.

Furthermore, the magnetic circuit of the miniature transducer according to the first aspect of the present invention may further comprise third and fourth air gap portions adapted to receive third and fourth voice coil segments, respectively, wherein magnetic flux acting on the third voice coil segment is provided by said inner magnetic means and second outer magnetic means in combination, and wherein magnetic flux acting on the fourth voice coil segment is essentially provided by said inner magnetic means only.

Thus, according to the first aspect of the present invention the magnetic flux in the third air gap may be generated by two magnetic means, such as two permanent magnets in combination. These two magnets may be the common inner magnet in combination with a second outer magnet. Contrary to this, the magnetic flux in the fourth air gap may primarily be generated by a single magnet only, said single magnet preferable being the common inner magnet. As already mentioned this implies that an outer magnet along the fourth air gap can be omitted whereby the width of the miniature transducer may be reduced.

Preferably, the first and third air gap portions are essentially linearly shaped air gap portions arranged in a substantially parallel manner. Similarly, the second and fourth air gap portions are preferably essentially linearly shaped air gap portions arranged in a substantially parallel manner. Thus, the four air gap portions preferably form a rectangular shape.

Each of the air gaps may have a width in the range 0.5-0.8 mm, such as around 0.6 mm. The average magnetic flux density in the air gap may be in the range 0.3-1.5 T, such as in the range 0.5-1 T, or any other subset of ranges therein.

The inner permanent magnet and/or the outer magnets may comprise NdFeB compounds having a remanence flux density of at least 1.2 T, a coercive force of at least 1000 kA/m and an energy product of at least 300 kJ/m$^3$. As an example, an NdFeB N44H may be applied.

In order to fit into the above-mentioned air gap structure the first and third voice coil segments may be essentially linearly shaped voice coil segments arranged in a substantially parallel manner. Similarly, the second and fourth voice coil segments may be essentially linearly shaped voice coil segments arranged in a substantially parallel manner. In order to form a complete voice coil, the first, second, third and fourth voice coil segments may be interconnected by curved bridging portions to form an essentially rectangularly shaped voice coil. Thus, the first, second, third and fourth voice coil segments may form a complete voice coil whereby the four voice coil segments carry the same voice coil current.

The impedance of the voice coil may be in the range 4-16%, such as around 8Ω. Preferably, the voice coil is made of a wound copper wire or a wound Copper-clad Aluminium (CCA) wire. In the case of a CCA wire the copper content may be around 15%. At typical operation an 8Ω (impedance) voice coil is driven by a voltage of around 2-5 $V_{RMS}$ in order to produce an electrical power of 1-2 W across the transducer.

The inner magnetic means, the first outer magnetic means and the second outer magnetic means may be arranged on a substantially plane base portion of a common pole piece, such as a magnetically permeable yoke being made of a ferromagnetic material. The common pole piece may comprise first and second outer pole piece portions, said first and second outer pole piece portions extending from the substantially plane base portion of the common pole piece. Preferably, the first and second outer pole piece portions extend in a substantially perpendicular direction from the substantially plane base portion of the common pole piece.

The magnetic circuit may further comprise first and second outer pole pieces arranged on the first and second outer magnetic means, respectively. Thus, the first and second outer pole pieces may be arranged on, or supported by, the first and second outer magnetic means along the first and third air gap portions.

Preferably, the first and second outer pole pieces form an integral part of a pole piece ring, said pole piece ring being arranged on the first and second pole piece portions of the common pole piece along the second and fourth air gap portions. Thus, the pole piece ring may be arranged on, or supported by, the first and second pole piece portions of the common pole piece along the second and fourth air gap portions. Preferably, the pole piece ring is constituted by a single pole piece element, said single pole piece element also forming an integral part of an exterior surface portion of the miniature transducer. Preferably, the diaphragm is attached to said pole piece ring. The magnetic circuit may further comprise an inner pole piece arranged on the inner magnetic means.

Suitable pole piece materials are low carbon content steel/iron materials, such as materials similar to Werkstoff-No. 1.0330 (St 2), 1.0333 (St 3), 1.0338 (St 4), all in accordance to DIN EN 10130.

In a second aspect, the present invention relates to a miniature electro-acoustic transducer comprising a diaphragm and a voice coil operatively connected to the diaphragm and a magnetic circuit comprising an inner permanent magnet assembly, an outer permanent magnet assembly, a magnetically permeable yoke, and first and second air gap portions conducting first and second magnetic flux densities, respectively, the first and second air gap portions having first and second voice coil segments, respectively, arranged therein, wherein the magnetic flux density in the first air gap portion is generated by superposition of magnetic flux generated by the inner permanent magnet assembly and magnetic flux generated by the outer permanent magnet assembly and the magnetic flux density in the second air gap portion is generated substantially exclusively by the inner permanent magnet assembly.

Despite the asymmetric nature of the magnetic circuit of the second aspect of the present invention the flux densities in the first and second air gaps are preferably essentially equal in strength.

As used herein, "operatively connected" is intended to mean that the voice coil may be attached directly to the diaphragm, or attached to the diaphragm via another element which is directly attached to the diaphragm.

As noted above, the terms "inner" and "outer" refer to the positioning of the magnet assemblies relative to a given air gap. Thus, an inner magnet assembly is positioning in the direction towards the center of the miniature transducer, i.e. on a center-side of a given air gap. Optionally an inner magnet assembly may coincide with a center point of the miniature transducer. Contrary to this, an outer magnet assembly is positioned on the opposite side of a given air gap.

In the miniature electro-acoustic transducer according to the second aspect, the magnetic circuit may further comprises third and fourth air gap portions adapted to receive third and fourth voice coil segments, respectively, wherein the magnetic flux density in the third air gap portion is generated by superposition of magnetic flux generated by the inner permanent magnet assembly and magnetic flux generated by the outer permanent magnet assembly, and wherein the magnetic flux density in the fourth air gap portion is generated substantially exclusively by the inner permanent magnet assembly.

Thus, the miniature electro-acoustic transducer according to the second aspect of the present provides an asymmetric magnetic circuit in that the magnetic fluxes in the first and second air gaps are generated in very different ways. Similar to the embodiment of the first aspect of the present invention the magnetic flux in the first (and third) air gap may be generated by two magnetic means, such as two permanent magnets, in combination. These two magnets may be a common inner magnet in combination with a first outer magnet. Contrary to this, the magnetic flux in the second (and fourth) air gap may be substantially exclusively (e.g., primarily) generated by a single magnet only, said single magnet preferable being the common inner magnet. In this way, an outer magnet along the second air gap can be omitted whereby the width of the miniature transducer may be reduced in a direction perpendicular to the orientation of the second air gap.

Preferably, the first and third air gap portions are essentially linearly shaped air gap portions arranged in a substantially parallel manner. Similarly, the second and fourth air gap portions are preferably essentially linearly shaped air gap portions arranged in a substantially parallel manner. Thus, the four air gap portions preferably form a rectangular shape.

Each of the air gaps may have a width in the range 0.5-0.8 mm, such as around 0.6 mm. The average magnetic flux density in the air gap may be in the range 0.3-1.5 T, such as in the range 0.5-1 T, or any other subset of ranges therein.

The inner permanent magnet assembly and/or the outer permanent magnet assembly may comprise permanent magnets comprising NdFeB compounds having a remanence flux density of at least 1.2 T, a coercive force of at least 1000 kA/m and an energy product of at least 300 kJ/m$^3$. As an example, an NdFeB N44H may be applied.

In order to fit into the above-mentioned air gap structure the first and third voice coil segments may be essentially linearly shaped voice coil segments arranged in a substantially parallel manner. Similarly, the second and fourth voice coil segments may be essentially linearly shaped voice coil segments arranged in a substantially parallel manner. In order to form a complete voice coil, the first, second, third and fourth voice coil segments may be interconnected by curved bridging portions to form an essentially rectangularly shaped voice coil. Thus, the first, second, third and fourth voice coil segments may form a complete voice coil whereby the four voice coil segments carry the same voice coil current.

The impedance of the voice coil may be in the range 4-16Ω, such as around 8Ω. Preferably, the voice coil is made of a wound copper wire or a wound Copper-clad Aluminium (CCA) wire. In the case of a CCA wire the copper content may be around 15%. At typical operation an 8Ω (impedance) voice coil is driven by a voltage of around 2-5 $V_{RMS}$ in order to produce an electrical power of 1-2 W across the transducer.

The inner permanent magnet assembly and the outer permanent magnet assembly may be arranged on the magnetically permeable yoke being made of a ferromagnetic material. The magnetically permeable yoke may comprise first and second outer pole piece portions, said first and second outer pole piece portions extending from the magnetically permeable yoke. Preferably, the first and second outer pole piece portions extend in a substantially perpendicular direction from the magnetically permeable yoke.

The magnetic circuit may further comprise first and second outer pole pieces arranged on first and second outer magnetic means, respectively, of the outer permanent magnet assembly. Thus, the first and second outer pole pieces may be arranged on, or supported by, the first and second outer magnetic means along the first and third air gap portions.

Preferably, the first and second outer pole pieces form an integral part of a pole piece ring, said pole piece ring being arranged on the first and second pole piece portions of the magnetically permeable yoke along the second and fourth air gap portions. Thus, the pole piece ring may be arranged on, or supported by, the first and second pole piece portions of the magnetically permeable yoke along the second and fourth air gap portions. Preferably, the pole piece ring is constituted by a single pole piece element, said single pole piece element also forming an integral part of an exterior surface portion of the miniature transducer. Preferably, the diaphragm is attached to said pole piece ring. The inner permanent magnet assembly may further comprise an inner pole piece arranged on an inner permanent magnet of the inner permanent magnet assembly.

Suitable pole piece materials are low carbon content steel/iron materials, such as materials similar to Werkstoff-No. 1.0330 (St 2), 1.0333 (St 3), 1.0338 (St 4), all in accordance to DIN EN 10130.

In a third aspect, the present invention relates to a miniature electro-acoustic transducer comprising a magnetic circuit, a diaphragm and a voice coil operatively connected to the diaphragm, wherein the magnetic circuit comprises first and second air gap portions adapted to receive first and second voice coil segments, respectively, wherein the first air gap portion is provided between inner magnetic means and first outer magnetic means, and wherein the second air gap portion is provided between said inner magnetic means and first outer pole piece means.

Similar to the first and second aspects of the present invention it is a characteristic feature of the miniature transducer according to the third aspect that the magnetic circuit is asymmetric in that the magnetic fluxes in the first and second air gaps are generated in very different ways. As previously mentioned the magnetic flux in the first air gap may be generated by two magnetic means, such as two permanent magnets, in combination. These two magnets may be a common inner magnet in combination with a first outer magnet. Contrary to this, the magnetic flux in the second air gap may be primarily generated by a single magnet only, said single magnet preferable being the common inner magnet. In this way, an outer magnet along the second air gap can be omitted whereby the width of the miniature transducer may be reduced in a direction perpendicular to the orientation of the second air gap. As previously mentioned, the strong asymmetric nature of the magnetic circuit of the present invention does not result in a significantly higher flux density in one air gap compared to the other air gap.

The magnetic circuit according to the third aspect of the present invention may further comprise third and fourth air gap portions adapted to receive third and fourth voice coil segments, respectively, wherein the third air gap portion is provided between said inner magnetic means and second outer magnetic means, and wherein the fourth air gap portion is provided between said inner magnetic means and second outer pole piece means.

Thus, according to the third aspect of the present invention the magnetic flux in the third air gap may be generated by two magnetic means, such as two permanent magnets, in combination. These two magnets may be the common inner magnet in combination with a second outer magnet. Contrary to this, the magnetic flux in the fourth air gap may primarily be generated by a single magnet only, said single magnet preferable being the common inner magnet. As already mentioned, this implies that an outer magnet along the fourth air gap can be omitted whereby the width of the miniature transducer may be reduced.

Preferably, the first and third air gap portions are essentially linearly shaped air gap portions arranged in a substantially parallel manner. Similarly, the second and fourth air gap portions are preferably essentially linearly shaped air gap portions arranged in a substantially parallel manner. Thus, the four air gap portions preferably form a rectangular shape.

Each of the air gaps may have a width in the range 0.5-0.8 mm, such as around 0.6 mm. The average magnetic flux density in the air gap may be in the range 0.3-1.5 T, such as in the range 0.5-1 T, or any other subset of ranges therein.

The inner permanent magnet and/or the outer magnets may comprise NdFeB compounds having a remanence flux density of at least 1.2 T, a coercive force of at least 1000 kA/m and an energy product of at least 300 kJ/$m^3$. As an example, an NdFeB N44H may be applied.

In order to fit into the above-mentioned air gap structure the first and third voice coil segments may be essentially linearly shaped voice coil segments arranged in a substantially parallel manner. Similarly, the second and fourth voice coil segments may be essentially linearly shaped voice coil segments arranged in a substantially parallel manner. In order to form a complete voice coil, the first, second, third and fourth voice coil segments may be interconnected by curved bridging portions to form an essentially rectangularly shaped voice coil. Thus, the first, second, third and fourth voice coil segments may form a complete voice coil whereby the four voice coil segments carry the same voice coil current.

The impedance of the voice coil may be in the range 4-16%, such as around 8Ω. Preferably, the voice coil is made of a wound copper wire or a wound Copper-clad Aluminium (CCA) wire. In the case of a CCA wire the copper content may be around 15%. At typical operation an 8Ω (impedance)

voice coil is driven by a voltage of around 2-5 $V_{RMS}$ in order to produce an electrical power of 1-2 W across the transducer.

The inner magnetic means, the first outer magnetic means and the second outer magnetic means may be arranged on a substantially plane base portion of a common pole piece, such as a magnetically permeable yoke being made of a ferromagnetic material. The common pole piece may comprise first and second outer pole piece portions, said first and second outer pole piece portions extending from the substantially plane base portion of the common pole piece. Preferably, the first and second outer pole piece portions extend in a substantially perpendicular direction from the substantially plane base portion of the common pole piece.

The magnetic circuit may further comprise first and second outer pole pieces arranged on the first and second outer magnetic means, respectively. Thus, the first and second outer pole pieces may be arranged on, or supported by, the first and second outer magnetic means along the first and third air gap portions.

Preferably, the first and second outer pole pieces form an integral part of a pole piece ring, said pole piece ring being arranged on the first and second pole piece portions of the common pole piece along the second and fourth air gap portions. Thus, the pole piece ring may be arranged on, or supported by, the first and second pole piece portions of the common pole piece along the second and fourth air gap portions. Preferably, the pole piece ring is constituted by a single pole piece element, said single pole piece element also forming an integral part of an exterior surface portion of the miniature transducer. Preferably, the diaphragm is attached to said pole piece ring. The magnetic circuit may further comprise an inner pole piece arranged on the inner magnetic means.

Suitable pole piece materials are low carbon content steel materials, such as materials similar to Werkstoff-No. 1.0330 (St 2), 1.0333 (St 3), 1.0338 (St 4), all in accordance to DIN EN 10130.

In a fourth aspect, the present invention relates to a diaphragm assembly comprising a suspension member comprising a center portion surrounded by a flexible surround, a piston member comprising a center portion and a first surround portion, the center portion of the piston member being operatively connected to the center portion of the suspension member, and a voice coil comprising first and second voice coil segments operatively connected to the piston member, wherein the first voice coil segment is operatively connected to the first surround portion of the piston member, and wherein the second voice coil segment is operatively connected to the center portion of the piston member.

Thus, according to the fourth aspect of the present invention an asymmetric arrangement of the voice coil segments relative to the diaphragm is provided in that the first voice coil segment is arranged below a flexible surround portion whereas the second voice coil segment is arranged below the center portion of the piston member.

The piston member may further comprise a second surround portion, and the voice coil may further comprise third and fourth voice coil segments. The third voice coil segment may be operatively connected to the second surround portion of the piston member, whereas the fourth voice coil segment may operatively connected to the center portion of the piston member.

Preferably, the first and second surround portions of the piston member are aligned with respective portions of the flexible surround. In this way, the first and third voice coil segments may be positioned immediately below respective portions of the flexible surround. The second and fourth voice coil segments may be operatively connected to the center portion of the piston member via respective distance pieces provided between the center portion of the piston member and the respective second and fourth voice coil segments.

The diaphragm may have a thickness in the range 5-25 μm. The diaphragm according to the present invention is a multilayer diaphragm where a second polymer film (piston) is attached to at least part of a bigger polymer film (suspension member). By laminating a diaphragm with another diaphragm the stiffness of specific regions of the diaphragm may be significantly increased. The types of polymer films may be polyarylate (PAR), polyetherimide (PEI), polyrtheretherketone (PEEK), polyphenylene sulphide (PPS), polyethylenenapthalate (PEN), terephtalate (PET) or polycarbonate (PC).

In a fifth aspect, the present invention relates to a diaphragm and a voice coil operatively connected to the diaphragm and a magnetic circuit comprising first and second air gap portions conducting first and second magnetic flux densities, respectively. The first air gap portion is arranged between magnetic flux generating elements, and the second air gap portion is arranged between a magnetic flux generating element and a magnetically permeable element.

Thus, according to the fifth aspect of the present invention the first air gap portion may be arranged between two permanent magnets, whereas the second air gap portion may be arranged between a permanent magnet and a magnetically permeable element, such as a pole piece.

The magnetic circuit may further comprise third and fourth air gap portions conducting third and fourth magnetic flux densities, respectively, wherein the third air gap portion may be arranged between magnetic flux generating elements, and wherein the fourth air gap portion may be arranged between a magnetic flux generating element and a magnetically permeable element. Thus, the third air gap portion may be arranged between two permanent magnets, whereas the fourth air gap portion may be arranged between a permanent magnet and a magnetically permeable element, such as a pole piece.

Preferably, the magnetic circuit of the fifth aspect of the present invention comprises an inner permanent magnet and two outer permanent magnets. The inner permanent magnet and one outer permanent magnet generate, in combination, the first magnetic flux density, whereas the inner permanent magnet and the other outer permanent magnet generate, in combination, the third magnetic flux density. Contrary to this the inner permanent magnet essentially generates the entire second and fourth flux densities.

In terms of further implementation, the electro-acoustic transducer according to the fifth aspect may be implemented following the design routes outlined in connection with the electro-acoustic transducer according to the first aspect of the present invention.

In a sixth aspect, the present invention relates to a miniature electro-acoustic transducer comprising a magnetic circuit, a diaphragm and a voice coil operatively connected to the diaphragm, the magnetic circuit comprising first and second air gap portions adapted to receive first and second voice coil segments, respectively, wherein magnetic flux acting on the first voice coil segment is provided by inner magnetic means and outer magnetic means in combination, and wherein magnetic flux acting on the second voice coil segment is essentially provided by said inner magnetic means only, wherein the inner magnetic means and the outer magnetic means are configured so that the magnetic flux densities in the first air gap portion and the second air gap portion are preferably essentially equal in strength.

By essentially equal in strength is meant that the magnetic flux densities differ less than 20%, such as less than 15%, such as less than 10% from each other.

In terms of further implementation, the electro-acoustic transducer according to the sixth aspect may be implemented following the design routes outlined in connection with the electro-acoustic transducer according to the first aspect of the present invention.

BRIEF DESCRIPTION OF THE DRAWINGS

The present invention will now be explained in further details with reference to the accompanying figures, wherein.

Figure 1:
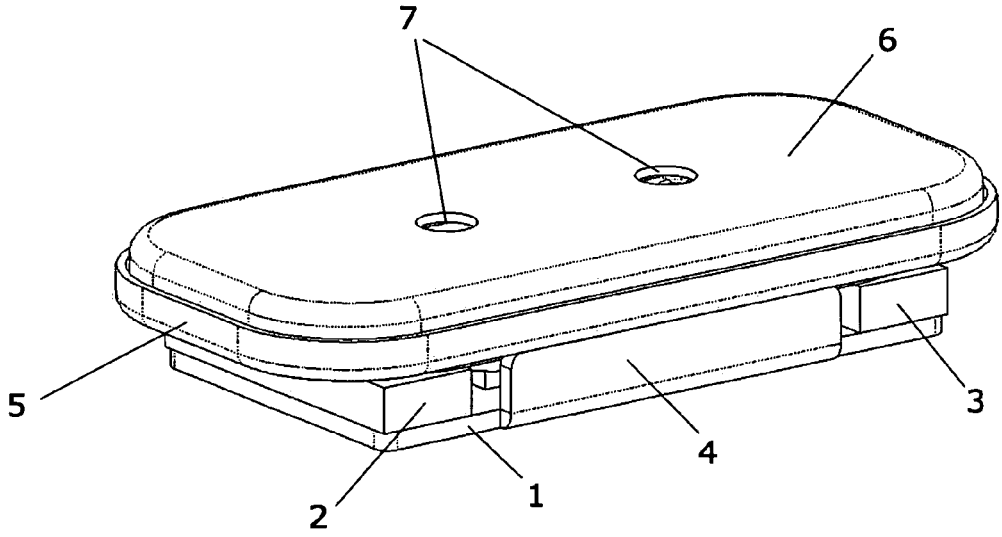
FIG. 1 shows a top perspective view of an assembled miniature transducer according to the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

As previously mentioned, it is a characteristic feature of the miniature transducer according to the present invention that the magnetic circuit is asymmetric in that magnetic fluxes in two substantially perpendicularly arranged air gaps portions are generated in very different ways. Thus, according to present invention the magnetic flux in a substantially linearly shaped first air gap is generated by two magnetic means, such as two permanent magnets, in combination whereas the magnetic flux in a substantially linearly shaped second air gap, said second air gap being oriented substantially perpendicular to the first air gap, is primarily generated by a single magnetic means only, said single magnetic means preferably being a permanent magnet. Despite the asymmetric nature of the magnetic circuit of the present invention the flux densities in the first and second air gaps are preferably essentially equal in strength.

According to the present invention a pair of outer magnets may be omitted whereby the dimension of the miniature transducer according to the present invention in at least one direction can be significantly reduced.

Thus, the miniature transducer according to the present invention meets some of the most important demands for future generations of miniature transducers for future mobile phones.

Referring now to FIG. 1, a top perspective view of a miniature transducer according to the present invention is depicted. FIG. 1 depicts an arrangement comprising a common yoke 1 of a ferromagnetic material and two outer magnets 2, 3 disposed thereon, an outer pole piece 4, a pole piece ring 5 and a cover 6 with two sound outlets 7. The pole piece ring 5 forms an integral part of the housing the miniature transducer. As previously mentioned, suitable pole piece materials are low carbon content steel materials, such as materials similar to Werkstoff-No. 1.0330 (St 2), 1.0333 (St 3), 1.0338 (St 4), all in accordance to DIN EN 10130. The outer magnets 2, 3 may comprise NdFeB compounds having a remanence flux density of at least 1.2 T, a coercive force of at least 1000 kA/m and an energy product of at least 300 kJ/m$^3$. As an example, an NdFeB N44H may be used.

The dimensions of the miniature transducer may be in the following ranges: width: 4-15 mm, length: 8-30 mm and height: 1-2 mm. Thus, the miniature transducer according to at least some aspects of the present invention possesses a strongly rectangular shape. The strong rectangular shape is a consequence of that two outer magnets are omitted compared to a traditional push-pull transducer arrangement.

Figure 2:
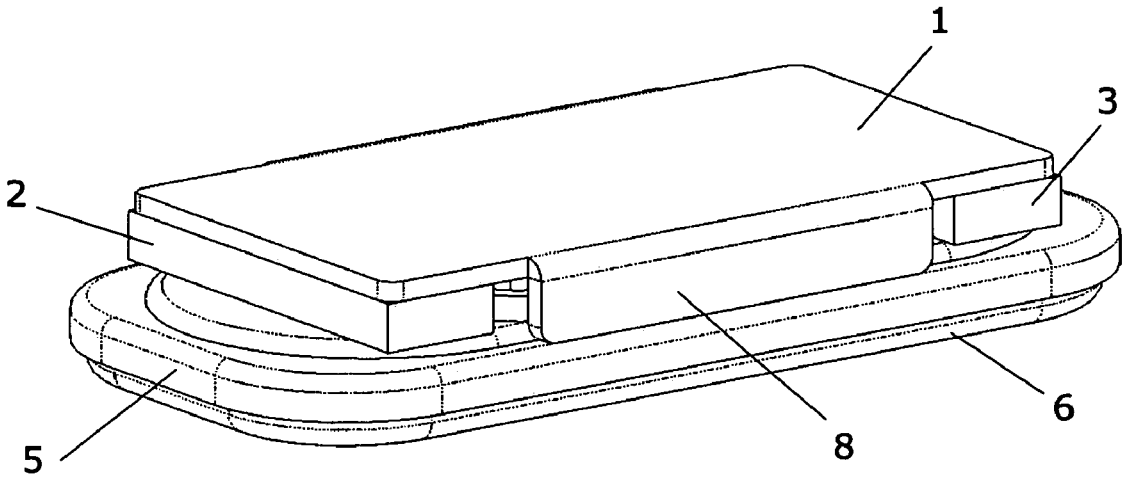
FIG. 2 shows a bottom perspective view of an assembled miniature transducer according to the present invention.

FIG. 2 shows a bottom perspective view of the miniature transducer according to the present invention. Similar to FIG. 1, the common yoke 1, the outer magnets 2, 3, the pole piece ring 5 and the cover 6 are depicted. Also, an outer pole piece 8 oppositely arranged relative to the outer pole piece 4 (of FIG. 1) is shown. As seen, the pole piece ring 5 is arranged on edges of outer pole pieces 4, 8 (only outer pole piece 8 is depicted in FIG. 2) and on outer magnets 2, 3.

Figure 3:
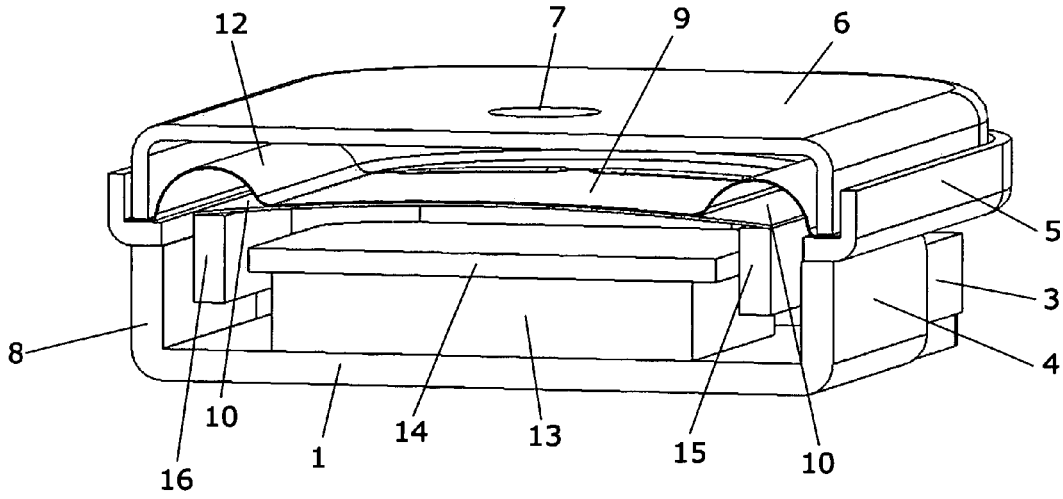
FIG. 3 shows a first perspective cross-sectional view of a miniature transducer.

FIG. 3 shows a cross-sectional perspective view across the width of the transducer according to the present invention. Similar to FIGS. 1 and 2, the common yoke 1, the outer pole pieces 4, 8, the outer magnet 3 (outer magnet 2 is not shown in FIG. 2), the pole piece ring 5 and the cover 6 (including one sound outlet 7) are shown. The outer pole pieces 4, 8 are implemented as bent portions of the common pole piece 1. However, they may also be fabricated separately and attached to the common yoke afterwards. As seen in FIG. 3, the pole piece ring 5 rests on the upper edges of outer pole pieces 4, 8 whereas cover 6 is attached to pole piece ring 5. A diaphragm 9 is attached between the pole piece ring 5 and the cover 6. A piston 10 is attached to a center portion of the diaphragm 9, the latter comprising a flexible surround 12 surrounding the center portion.

As previously mentioned, the diaphragm 9 may have a thickness in the range 5-μm. The diaphragm 9 may advantageously comprise a multi-layer diaphragm where the piston 10, in the form of a polymer film, is attached to a center portion of the diaphragm, another polymer film 9. By laminating a diaphragm with another diaphragm, the stiffness of specific regions of the diaphragm may be significantly increased. The types of polymer films may be polyarylate (PAR), polyetherimide (PEI), polyrtheretherketone (PEEK), polyphenylene sulphide (PPS), polyethylenenapthalate (PEN), terephtalate (PET) or polycarbonate (PC).

An inner magnet 13 is arranged on the common yoke 1. The inner magnet 13 is preferably a permanent magnet comprising NdFeB compounds having a remanence flux density of at least 1.2 T, a coercive force of at least 1000 kA/m and an energy product of at least 300 kJ/m$^3$. As an example, an NdFeB N44H may be applied.

An inner pole piece 14 is arranged on the inner magnet 13, thereby forming air gaps between inner pole piece 14 and outer pole pieces 4, 8. These air gaps are adapted to receive respective voice coil segments 15, 16 which are both attached to piston 10. As depicted in FIG. 3, voice coil segments 15, 16 are positioned immediately below the flexible surrounds, i.e. outside the center portion of the diaphragm. Suitable pole piece materials for the inner pole piece 14 include low carbon content steel materials in accordance with DIN EN 10130.

The flux experienced by voice coil segments 15, 16 is primarily provided by inner magnet 13 in that no outer magnets are provided on the outside of voice coil segments 15, 16. By primarily is meant that, especially at the corner sections, i.e. where two substantially linearly shaped voice coil segments meet, an outer magnet, for example outer magnet 3, may generate flux that may slightly act on voice coil segments 15, 16.

The air gaps housing voice coil segments 15, 16 may have a width in the range 0.5-0.8 mm, such as around 0.6 mm. The average magnetic flux density in the air gap may be in the range 0.3-1.5 T, such as in the range 0.5-1 T, or any other subset of ranges therein.

Figure 4:
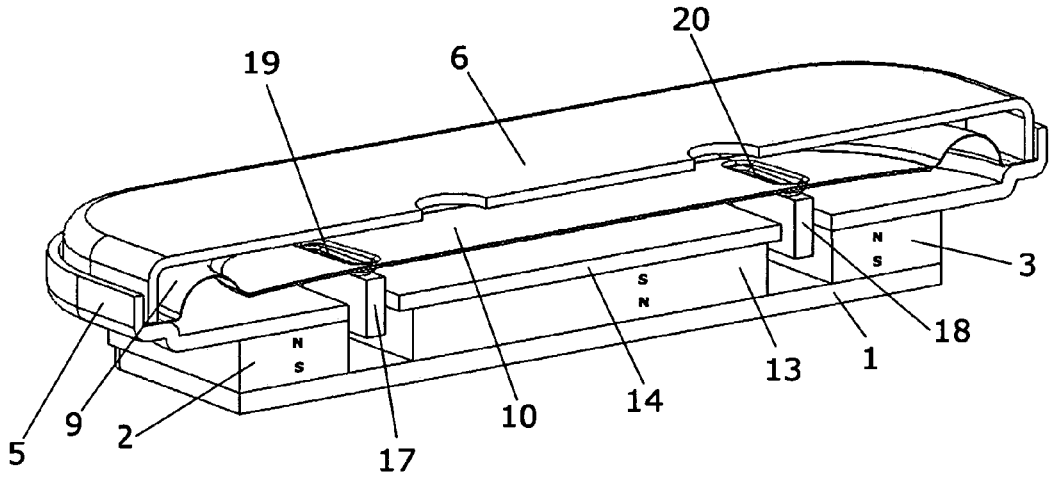
FIG. 4 shows a second perspective cross-sectional view of a miniature transducer.

Referring now to FIG. 4, another cross-sectional view of a miniature transducer according to the present invention is depicted. Compared to the cross-sectional view of FIG. 3, the cross-sectional view shown in FIG. 4 is rotated 90 degrees in relation thereto. Again, the structural arrangements of the common yoke 1, the inner magnet 13, the outer magnets 2, 3, the inner pole piece 14 and the pole piece ring 5 are depicted.

As seen in FIG. 4, air gaps are provided between the inner pole piece 14 and the pole piece ring 5. The air gaps are adapted to receive respective voice coil segments 17, 18. Contrary to voice coil segments 15, 16, voice coil segment 17 experiences flux generated by inner magnet 13 and outer magnet 2 in combination. Similarly, voice coil segment 18 experiences flux generated by inner magnet 13 and outer magnet 3 in combination. Thus, the fluxes acting on voice coil segments 17 and 18 are generated by oppositely arranged inner and outer magnets meaning that voice coil segments 17 and 18 are both exposed to enhanced fluxes.

The air gaps housing voice coil segments 17, 18 may have a width in the range 0.5-0.8 mm, such as around 0.6 mm. The average magnetic flux density in the air gap may be in the range 0.3-1.5 T, such as in the range 0.5-1 T.

Voice coil segments 17, 18 are both attached to piston 10 via distance elements 19, 20. These distance elements 19, 20 compensate for the fact that the voice coil segments 15, 16 of FIG. 3 are positioned lower than the center portion of the piston. Thus, in order to secure proper attachment to the piston distance elements 19, 20 need to be inserted between voice coil segments 18, 19 and a center portion of the piston 10 to which they are attached. The distance elements 19, 20 are preferably integrated in the piston 10.

Figure 5:
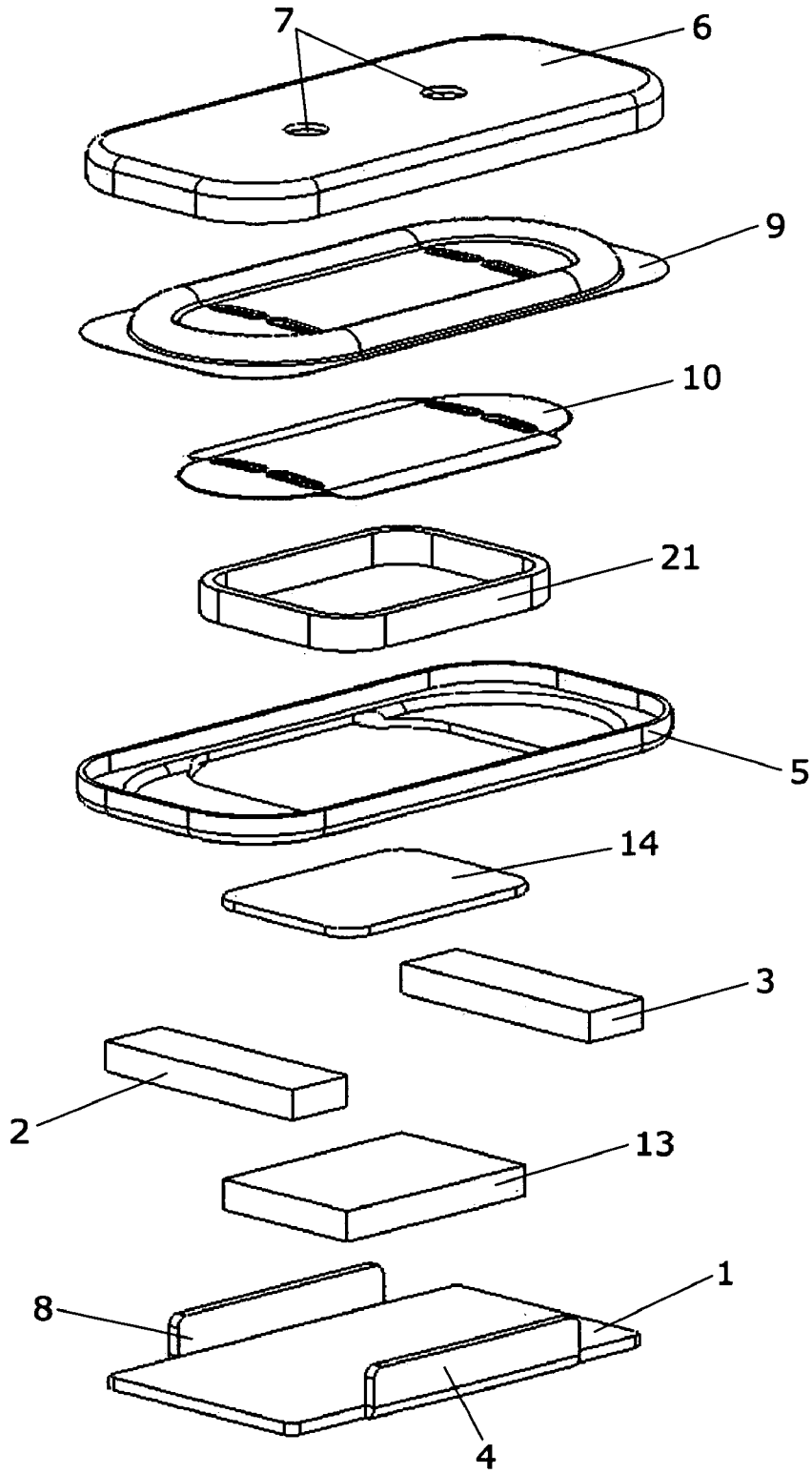
FIG. 5 shows an exploded perspective view of a miniature transducer.

An exploded view of the miniature transducer according to the present invention is shown in FIG. 5, which shows the common yoke 1 with integrated outer pole pieces 4, 8, the inner magnet 13, the outer magnets 2, 3, the inner pole piece 14 and the pole piece ring 5. The shapes of the magnets are shown as being rectangular, but other shapes may also be used in accord with the present concepts. As previously mentioned, the pole piece ring 5 also serves as an exterior surface portion of the housing of the miniature transducer.

To fit into the four air gap portions provided around the edges of the inner magnet 13, a rectangularly shaped voice coil 21 is provided. The voice coil 21 comprises previously mentioned voice coil segments 15, 16, 17, 18 interconnected by four corner or bridging portions. The impedance of the voice coil 21 may be in the range 4-16Ω, such as around 8Ω. Preferably, the voice coil is made of a wound copper wire or a wound Copper-clad Aluminium (CCA) wire. In the case of a CCA wire the copper content may be around 15%. At typical operation an 8Ω (impedance) voice coil is driven by a voltage of around 2-5 $V_{RMS}$ in order to produce an electrical power of 1-2 W across the transducer.

The voice coil 21 is attached to piston 10 which is secured to diaphragm 9. The diaphragm 9 is kept in position be positioning it between the cover 6 and the pole piece ring 5. A number of sound outlets 7, not necessary two (i.e., one or more), are provided in the cover 6.

An assembled miniature transducer according to the present invention further comprises suitable electric terminals for providing electrical access to the moving voice coil of the transducer.

What is claimed is:

1. A miniature electro-acoustic transducer comprising:

a diaphragm and a voice coil operatively connected to the diaphragm; and a magnetic circuit comprising an inner permanent magnet assembly and an outer permanent magnet assembly, a magnetically permeable yoke, and first and second air gap portions conducting first and second magnetic flux densities, respectively, the first and second air gap portions having first and second voice coil segments, respectively, arranged therein, wherein the magnetic flux density in the first air gap portion is generated by superposition of magnetic flux generated by the inner permanent magnet assembly and magnetic flux generated by the outer permanent magnet assembly, and wherein the magnetic flux density in the second air gap portion is generated substantially exclusively by the inner permanent magnet assembly.

2. A miniature electro-acoustic transducer according to claim 1, wherein the magnetic circuit further comprises third and fourth air gap portions adapted to receive third and fourth voice coil segments, respectively, wherein the magnetic flux density in the third air gap portion is generated by superposition of magnetic flux generated by the inner permanent magnet assembly and magnetic flux generated by the outer permanent magnet assembly, and wherein the magnetic flux density in the fourth air gap portion is generated substantially exclusively by the inner permanent magnet assembly.

3. A miniature electro-acoustic transducer according to claim 2, wherein the first and third air gap portions are essentially linearly shaped air gap portions arranged in a substantially parallel manner.

4. A miniature electro-acoustic transducer according to claim 2, wherein the second and fourth air gap portions are essentially linearly shaped air gap portions arranged in a substantially parallel manner.

5. A miniature electro-acoustic transducer according to claim 2, wherein the first and third voice coil segments are essentially linearly shaped voice coil segments arranged in a substantially parallel manner.

6. A miniature electro-acoustic transducer according to claim 2, wherein the second and fourth voice coil segments are essentially linearly shaped voice coil segments arranged in a substantially parallel manner.

7. A miniature electro-acoustic transducer according to claim 6, wherein the first, second, third and fourth voice coil segments are interconnected by curved bridging portions whereby forming an essentially rectangular shaped voice coil.

8. A miniature electro-acoustic transducer according to claim 2, wherein the inner and outer permanent magnet assemblies are arranged on a substantially plane portion of the magnetically permeable yoke.

9. A miniature electro-acoustic transducer according to claim 8, wherein the magnetically permeable yoke comprises first and second outer pole piece portions, said first and second outer pole piece portions extending from the substantially plane portion of the magnetically permeable yoke.

10. A miniature electro-acoustic transducer according to claim 9, wherein the first and second outer pole piece portions extend in a substantially perpendicular direction from the substantially plane portion of the magnetically permeable yoke.

11. A miniature electro-acoustic transducer according to claim 2, wherein the magnetic circuit further comprises first and second outer pole pieces arranged on first and second permanent magnets, respectively, of the outer permanent magnet assembly.

12. A miniature electro-acoustic transducer according to claim 11, wherein the first and second outer pole pieces form an integral part of a pole piece ring, said pole piece ring being arranged on the first and second pole piece portions of the magnetically permeable yoke along the second and fourth air gap portions.

13. A miniature electro-acoustic transducer according to claim 12, wherein the diaphragm is attached to said pole piece ring.

14. A miniature electro-acoustic transducer according to claim 12, wherein the pole piece ring forms an exterior housing part of the transducer.

15. A miniature electro-acoustic transducer according to claim 1, wherein the inner permanent magnet assembly comprises an inner pole piece arranged on an inner permanent magnet.

16. A miniature electro-acoustic transducer comprising a magnetic circuit, a diaphragm and a voice coil operatively connected to the diaphragm, wherein the magnetic circuit comprises first and second air gap portions adapted to receive first and second voice coil segments, respectively, wherein the first air gap portion is provided between inner magnetic means and first outer magnetic means, and wherein the second air gap portion is provided between said inner magnetic means and first outer pole piece means, and wherein the first and second air gap portions are arranged essentially perpendicular to each other.

17. A miniature electro-acoustic transducer according to claim 16, wherein the magnetic circuit further comprises third and fourth air gap portions adapted to receive third and fourth voice coil segments, respectively, wherein the third air gap portion is provided between said inner magnetic means and second outer magnetic means, and wherein the fourth air gap portion is provided between said inner magnetic means and second outer pole piece means, and wherein the third and fourth air gap portions are arranged essentially perpendicular to each other.

18. A miniature electro-acoustic transducer comprising a magnetic circuit, a diaphragm and a voice coil operatively connected to the diaphragm, wherein the magnetic circuit comprises first and second air gap portions adapted to receive first and second voice coil segments, respectively, wherein magnetic flux acting on the first voice coil segment is provided by inner magnetic means and first outer magnetic means in combination, and wherein magnetic flux acting on the second voice coil segment is essentially provided by said inner magnetic means only.

19. A miniature electro-acoustic transducer according to claim 18, wherein the magnetic circuit further comprises third and fourth air gap portions adapted to receive third and fourth voice coil segments, respectively, wherein magnetic flux acting on the third voice coil segment is provided by said inner magnetic means and second outer magnetic means in combination, and wherein magnetic flux acting on the fourth voice coil segment is essentially provided by said inner magnetic means only.

20. A miniature electro-acoustic transducer comprising a magnetic circuit, a diaphragm and a voice coil operatively connected to the diaphragm, the magnetic circuit comprising first and second air gap portions adapted to receive first and second voice coil segments, respectively, wherein magnetic flux acting on the first voice coil segment is provided by inner magnetic means and outer magnetic means in combination, and wherein magnetic flux acting on the second voice coil segment is essentially provided by said inner magnetic means only, wherein the inner magnetic means and the outer magnetic means are configured so that the magnetic flux densities in the first air gap portion and the second air gap portion are essentially equal in strength.

21. A miniature electro-acoustic transducer according to claim 20, wherein the strength of the magnetic flux densities in the first and second air gap portions differ less than 20%.

* * * * *